US005494027A

United States Patent [19]

Maughan

[11] Patent Number: 5,494,027

[45] Date of Patent: Feb. 27, 1996

[54] RANGETOP BURNER GRATE FOR UNIFORM HEATING DURING SIMMER OPERATION

[75] Inventor: James R. Maughan, Scotia, N.Y.

[73] Assignee: General Electric Company, Schenectady, N.Y.

[21] Appl. No.: 366,643

[22] Filed: Dec. 30, 1994

[51] Int. Cl.[6] ..... F24C 15/10

[52] U.S. Cl. ..... 126/214 D; 126/152 R; 126/214 C; 126/212; 126/218; 126/332

[58] Field of Search ..... 126/214 D, 332, 126/152 R, 218, 214 C, 212

[56] References Cited

U.S. PATENT DOCUMENTS

| | | | |
|---|---|---|---|
| 1,366,365 | 1/1921 | Donnelly | 126/214 D |
| 1,574,525 | 2/1926 | Wilcox | 126/214 D |
| 1,692,000 | 11/1928 | Steffens | 126/214 D |
| 2,030,519 | 2/1936 | Hamilton | 126/215 |
| 4,616,626 | 10/1986 | Soon | 126/41 R X |

*Primary Examiner*—Larry Jones
*Attorney, Agent, or Firm*—Paul R. Webb, II

[57] ABSTRACT

Simmer performance in gas ranges is improved by providing a burner grate with a flame impingement ring centered over the gas burner. The burner grate includes a base and a plurality of fingers attached to the base. The flame impingement ring is attached to all or some of the fingers. The flame impingement ring is sized so that simmer flames from the gas burner will impinge thereon. Thus, the flames are directed away from direct impingement on the cooking utensil, and some heat from the flames is absorbed by the grate. The flame impingement ring can have many cross-sectional configurations including curved, circular, oval or straight.

15 Claims, 5 Drawing Sheets

RANGETOP BURNER GRATE FOR UNIFORM HEATING DURING SIMMER OPERATION

BACKGROUND OF THE INVENTION

This invention relates generally to gas ranges and more particularly to a burner grate for improving burner simmer performance.

Household gas ranges typically have a number of gas burners located on the cooktop. A burner grate is situated over each burner for supporting a cooking utensil such as a pot or pan above the burner. The gas burners typically comprise a cylindrical burner head having a plurality of ports formed therein. A fuel-air mixture is discharged through the ports to produce the flame.

Adequate simmer performance is an important criterion in gas range burner design. Simmer performance is usually defined in terms of the minimum stable input rate of the burner; that is, the lowest input rate at which the burner is able to support a stable flame. However, the minimum stable input rate is not necessarily a good indication of simmer performance. This is evidenced by FIG. 1 which shows the local heat flux distribution across a typical cooking utensil (nine inch diameter) for five different input rates. In each instance, a sharp peak in flux occurs at the point where the flame impinges on the cooking utensil. As expected, heat fluxes are higher for the greater input rates of 8800 and 4800 BTU/hr. The peak heat flux for the input rate of 2500 BTU/hr is approximately 9000 BTU/hr/ft$^2$ and occurs about 1.5 inches from the centerline. Reducing the input rate to 1500 BTU/hr, which is considered a simmer setting, results in only a slight reduction in the peak heat flux. Consequently, simmer performance is not significantly improved by this reduction in input rate. The local heat flux does begin to drop significantly as the input rate approaches 1000 BTU/hr, but most conventional gas burners are unable to support a stable flame at input rates this low.

Accordingly, there is a need for a means to improve the simmer performance of rangetop gas burners.

SUMMARY OF THE INVENTION

The above-mentioned needs are met by the present invention which provides a burner grate comprising a base having a center point, a plurality of fingers attached to the base, and a flame impingement ring attached to all or some of the fingers. The flame impingement ring is sized so that simmer flames from a gas burner will impinge thereon. Generally, the flame impingement ring will have an inside diameter which is substantially equal to the diameter of the gas burner. The flame impingement ring can have many cross-sectional configurations including curved, circular, oval or straight. The presence of the flame impingement ring directs simmer flames away from direct impingement on a cooking utensil so that there is a more uniform distribution of heat flux and simmer performance is improved. The flame impingement ring also absorbs heat from the flames and conducts the heat throughout the grate.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 2:
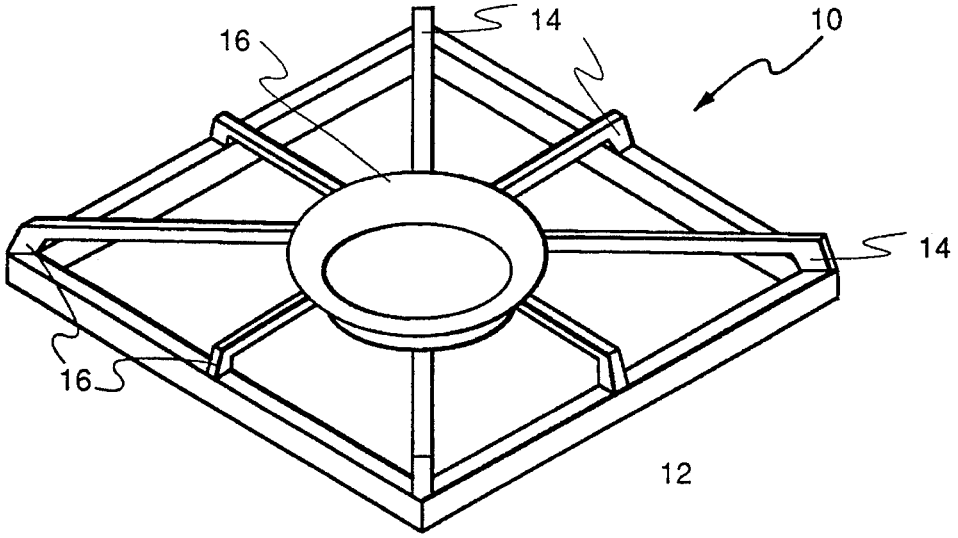
FIG. 2 is a perspective view of the burner grate in accordance with the present invention.

Referring to the drawings wherein identical reference numerals denote the same elements throughout the various views, FIG. 2 shows a burner grate 10 in accordance with the present invention. The grate 10 comprises a base 12 and a plurality of utensil-supporting fingers 14. The base 12 is a rectangular frame-like member designed to rest on the cooktop of a gas range so as to be centered around a gas burner. It should be noted that the base 12 is not limited to a rectangular shape; other shapes, such as circular, are equally possible. The fingers 14 are attached at one end to the top surface of the base 12 and extend radially inward to the center point of the base 12. The fingers 14 are thus arranged in a common plane above the base 12 so as to be able to support a cooking utensil over a gas burner when the grate 10 is positioned on the rangetop.

A flame impingement ring 16 is fixed to the distal ends of the fingers 14 so that the center point of the ring 16 is vertically, or axially, aligned with the center point of the base 12. As shown in FIG. 2, the ring 16 is supported by all of the fingers 14. In this way heat absorbed by the ring 16 can be conducted to each finger. Alternate configurations are possible. For example, the ring 16 could be supported by only the four fingers extending from the midpoints of the sides of the base 12, not the fingers extending from the corners of the base. The base 12, fingers 14 and ring 16 are preferably integrally formed to ensure good thermal conduction throughout the grate 10, although the ring 16 can also be separately attached to all or some of the fingers 14 in a conventional manner such as welding as long as there is good thermal conduction. The flame impingement ring 16 is preferably made of the same material as the rest of the grate 10. Suitable materials include cast iron or aluminum or other materials with a high thermal conductivity.

Figure 3:
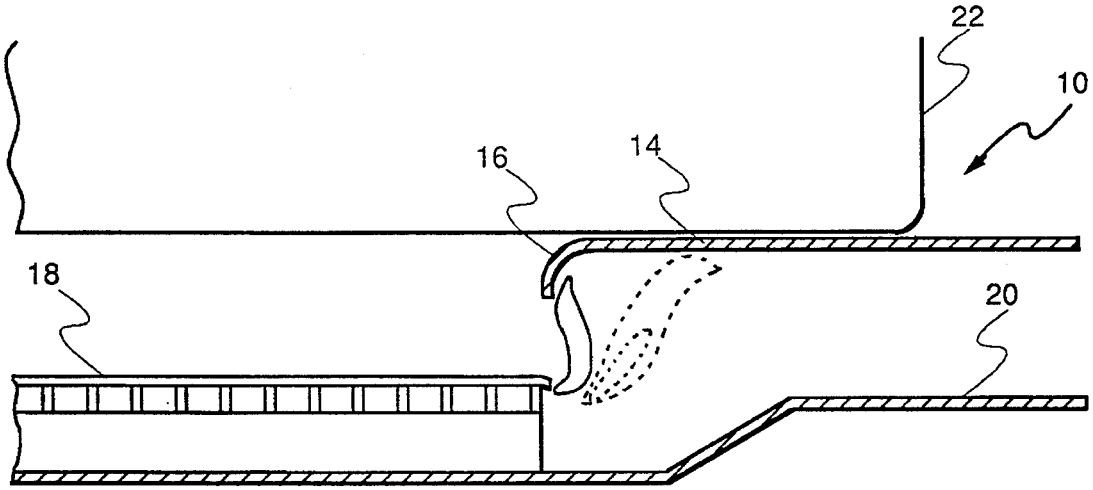
FIG. 3 is a side view of a first embodiment of the burner grate and a gas burner, the burner grate being shown in cross-section.

FIG. 3 shows the burner grate 10 situated over a gas burner 18 of a gas range. The grate 10 rests on the cooktop 20 of the range in order to support a cooking utensil 22 above the gas burner 18. The flame impingement ring 16 is centered over the gas burner 18 when the grate 10 is properly positioned on the cooktop 20. The ring 16 is sized so that simmer flames from the gas burner 18 will impinge on the ring. Specifically, the inside diameter of the ring 16 is substantially equal to or slightly less than the diameter of the gas burner 18, and the outside diameter of the ring 16 extends slightly beyond the point where simmer flames extend. The ring 16 curves inward and downward so as to be concave with respect to the cooktop 20 of the range. The inner rim of the ring 16 is thus closer to the gas burner 18 than the outer rim.

Figure 1:
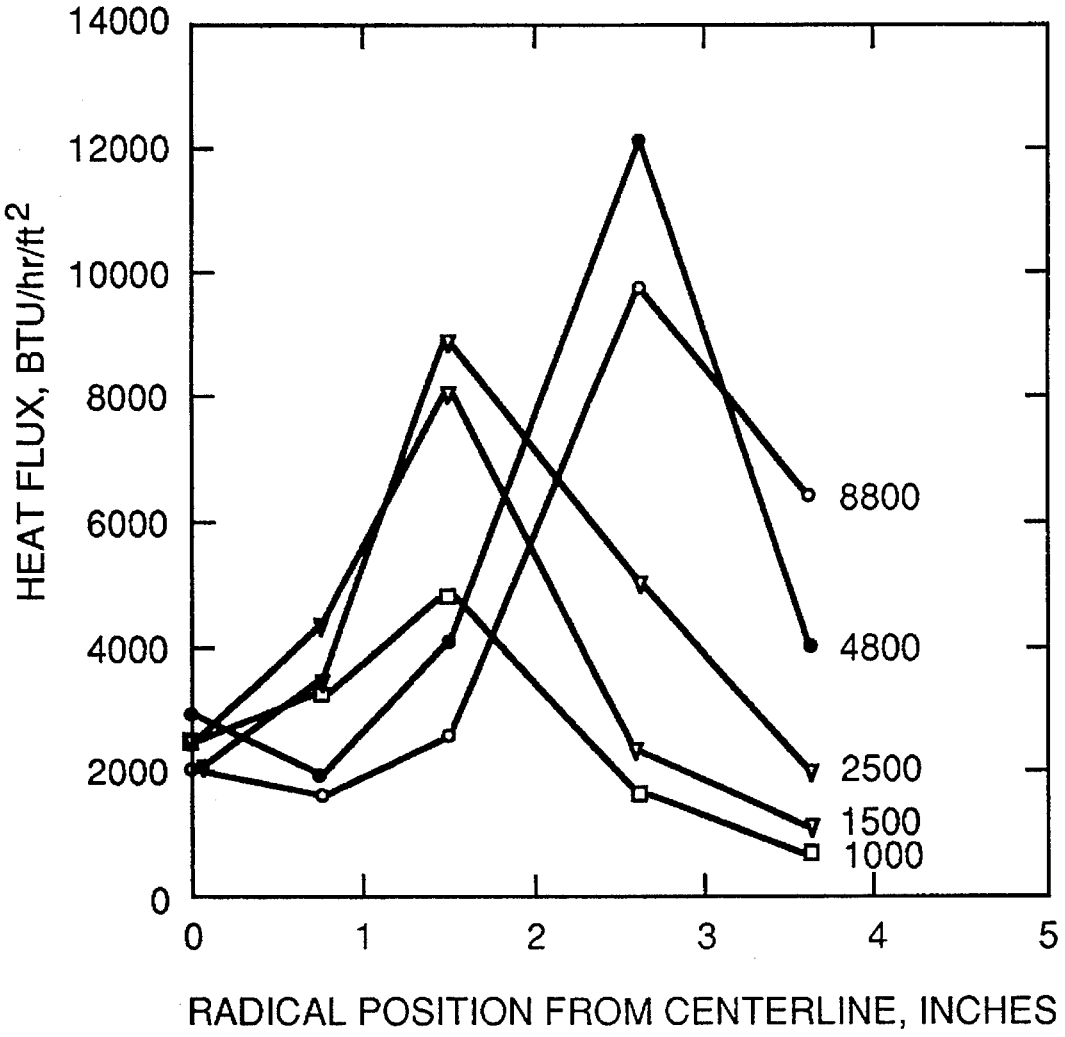
FIG. 1 is a graph showing the heat flux distributions across a cooking utensil for various input rates using a conventional burner grate.

When the burner 18 operates at normal input rates (i.e., above simmer), the flames (shown in dotted lines) pass beyond the flame impingement ring 16 and burner performance is unaffected. During simmer operation however, the flames (shown in solid lines) are smaller and consequently impinge on the ring 16. The simmer flames are thus redirected by the ring 16 away from direct impingement on the cooking utensil 22, thereby eliminating the hot spot that exists with conventional burner grates as is evident in FIG. 1. The result is a more uniform heat flux distribution and better simmer performance for a given input rate. In addition, the ring 16 will absorb heat from the flames impinging thereon, and this heat will be conducted to the fingers 14 and the base 12. Thus, the total heat input to the utensil 22 will be reduced for a given input rate, further improving simmer performance.

Figure 4:
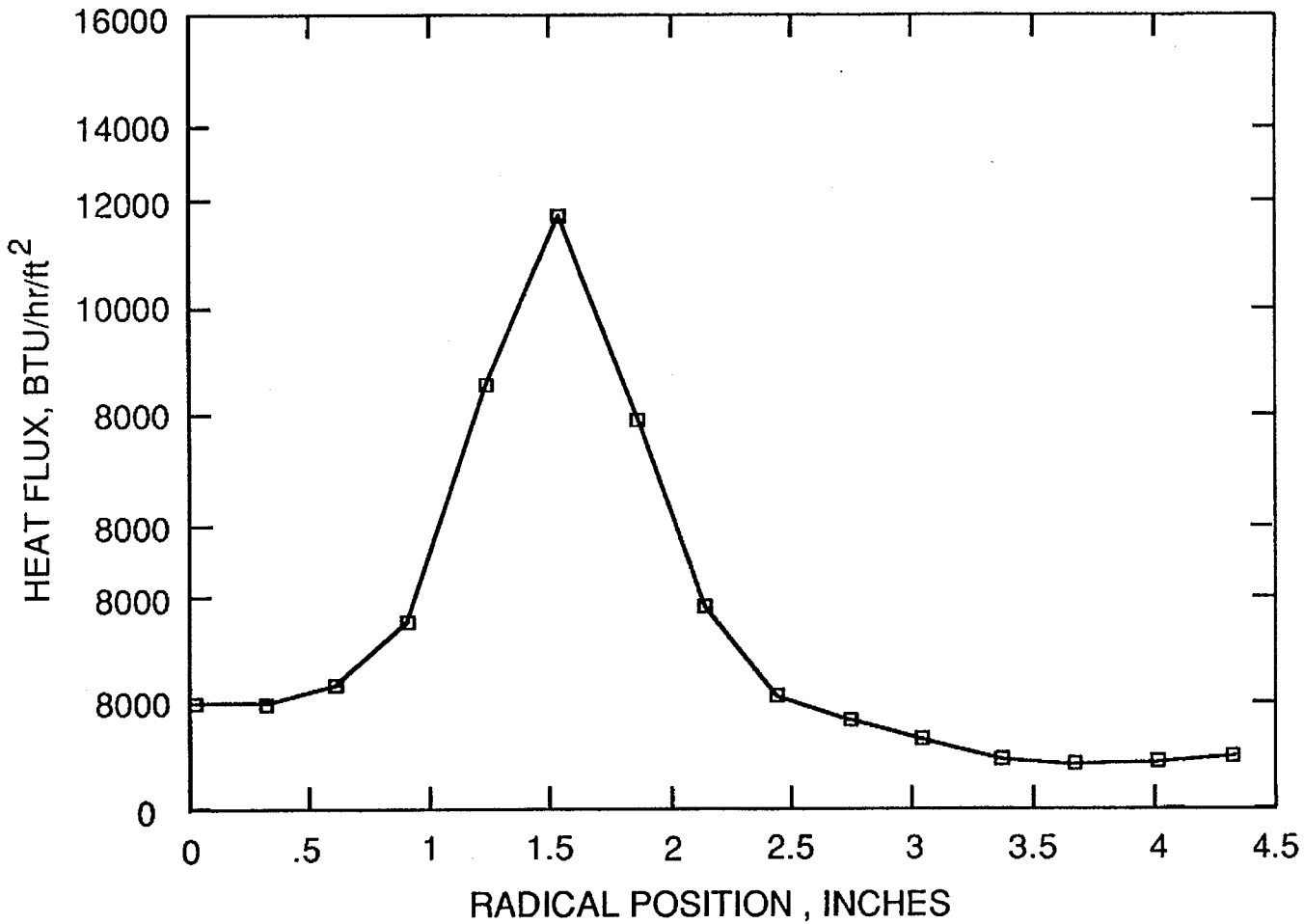
FIG. 4 is a graph showing the heat flux distribution across a cooking utensil at an input rate of about 1500 BTU/hr using a conventional burner grate.
Figure 5:
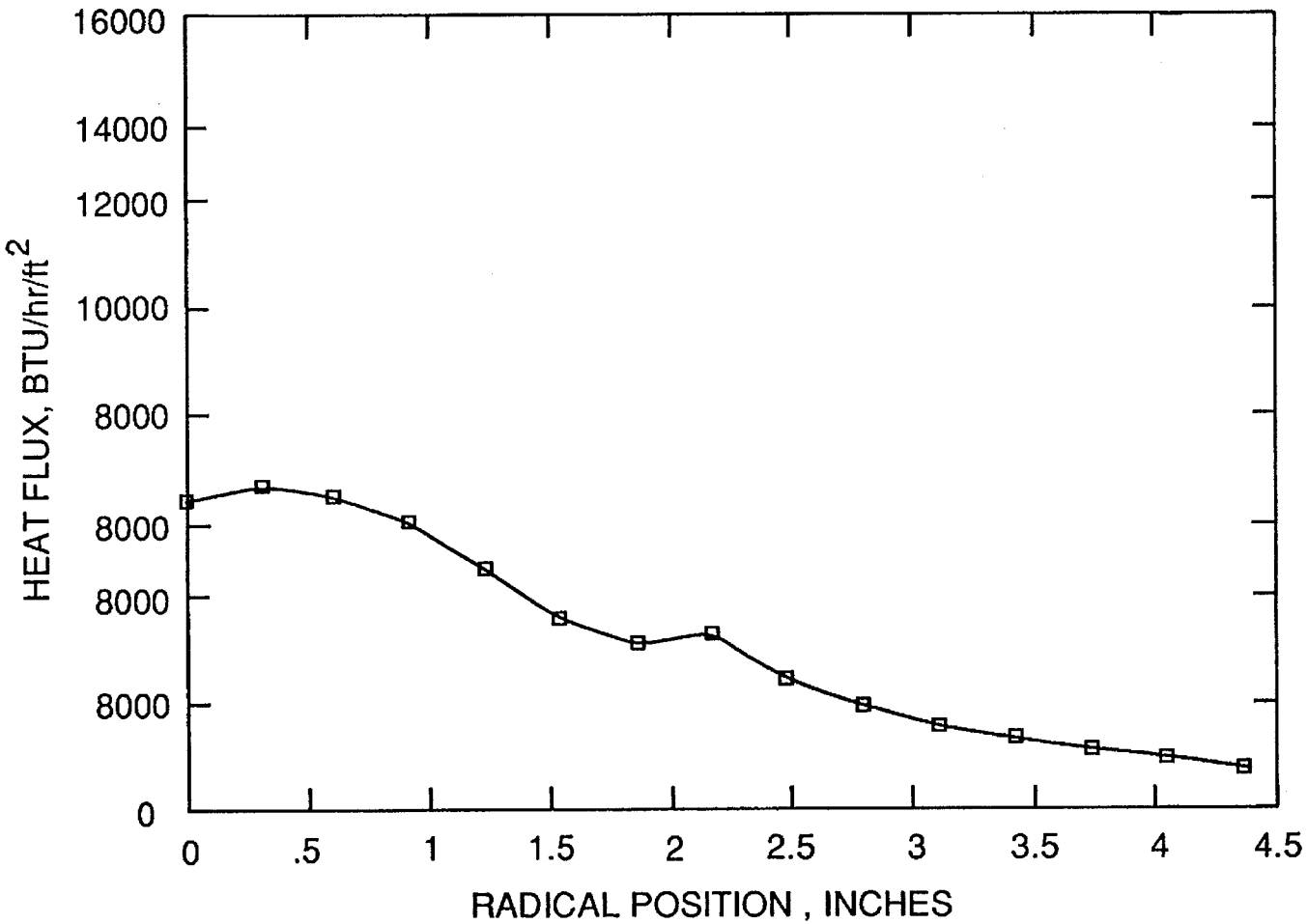
FIG. 5 is a graph showing the heat flux distribution across a cooking utensil at an input rate of about 1500 BTU/hr using the burner grate of the present invention.

The better simmer performance achieved by the present invention is shown graphically in FIGS. 4 and 5. FIG. 4 shows the heat flux distribution that occurs with a gas burner operating at an input rate of 1499 BTU/hr with a conventional grate. FIG. 5 shows the local heat flux distribution that results when using the same burner with the grate 10 of the present invention and at an input rate of 1510 BTU/hr. As can be seen, the peak heat flux in FIG. 5 is significantly less than that of FIG. 4 and is closer to the center. Also, the total heat into the utensil, which is the area under the curve, is reduced by the present invention because thermal conduction through the grate 10 removes energy from the system, as described above. The total heat into the utensil is 1260 BTU/hr in FIG. 4 and 967 BTU/hr in FIG. 5.

Figure 6:
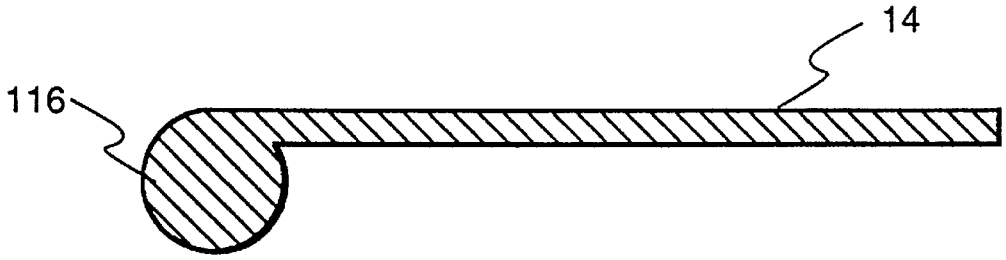
FIG. 6 is a side view of a second embodiment of the burner grate.
Figure 7:
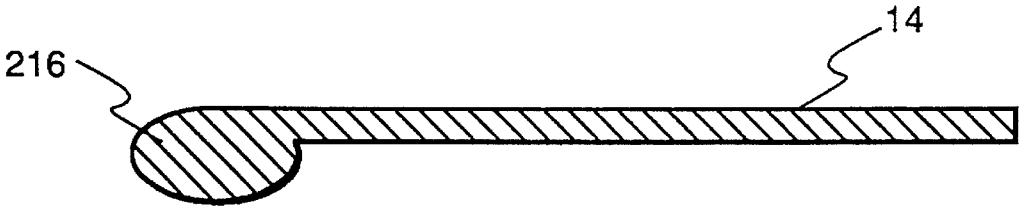
FIG. 7 is a side view of a third embodiment of the burner grate.
Figure 8:
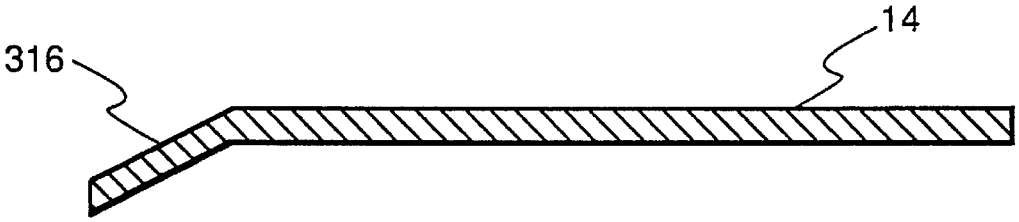
FIG. 8 is a side view of a fourth embodiment of the burner grate.

The flame impingement ring 16 is not limited to the curved cross-sectional configuration of FIG. 3; other configurations are possible. For instance, FIG. 6 shows a flame impingement ring 116 having a circular cross-sectional configuration, and FIG. 7 shows a flame impingement ring 216 having an oval cross-sectional configuration. These embodiments present large thermal masses for absorbing heat. FIG. 8 shows a flame impingement ring 316 which is straight in cross-section and angled downward with respect to the fingers 14, thereby having a frustoconical shape. This ring 316 will tend to distribute simmer flames farther away from the center of the cooking utensil.

The foregoing has described a burner grate which improves the simmer performance of a gas range. While specific embodiments of the present invention have been described, it will be apparent to those skilled in the art that various modifications thereto can be made without departing from the spirit and scope of the invention as defined in the appended claims.

What is claimed is:

1. A burner grate comprising:

a base having a center point;

a plurality of fingers having proximal ends attached to said base, and distal ends spaced radially inwardly from said base adjacent to said center point; and a flame impingement ring attached to at least some of said plurality of fingers coaxially with said center point, and including an inner rim defining an opening around said center point, and an outer rim disposed at said finger distal ends so that a burner flame may be selectively directed in impingement against said ring during simmer operation and directed radially outwardly of said ring during operation above simmer.

2. The burner grate of claim 1 wherein all of said plurality of fingers contact said flame impingement ring.

3. The burner grate of claim 1 wherein said flame impingement ring is curved in radial cross-section.

4. The burner grate of claim 1 wherein said flame impingement ring is circular in radial cross-section.

5. The burner grate of claim 1 wherein said flame impingement ring is oval in radial cross-section.

6. The burner grate of claim 1 wherein said flame impingement ring is straight in radial cross-section.

7. A burner grate for a range having at least one gas burner, said burner grate comprising:

a base having a center point;

a plurality of fingers having proximal ends attached to said base, and distal ends spaced radially inwardly from said base adjacent to said center point; and a flame impingement ring attached to at least some of said plurality of fingers coaxially with said center point, and including an inner rim defining an opening around said center point, and an outer rim disposed at said finger distal ends so that a burner flame may be selectively directed in impingement against said ring during simmer operation, and directed radially outwardly of said ring during operation above simmer.

8. The burner grate of claim 7 wherein said flame impingement ring has an inside diameter at said inner rim which is substantially equal to the diameter of said gas burner.

9. The burner grate of claim 7 wherein all of said plurality of fingers contact said flame impingement ring.

10. The burner grate of claim 7 wherein said flame impingement ring is curved in radial cross-section.

11. The burner grate of claim 7 wherein said flame impingement ring is circular in radial cross-section.

12. The burner grate of claim 7 wherein said flame impingement ring is oval in radial cross-section.

13. The burner grate of claim 7 wherein said flame impingement ring is straight in radial cross-section.

14. A gas range comprising:

at least one gas burner;

a burner grate situated coaxially over said gas burner, said burner grate comprising:

a base having a center point;

a plurality of fingers having proximal ends attached to said base, and distal ends spaced radially inwardly from said base adjacent to said center point; and a flame impingement ring attached to at least some of said plurality of fingers coaxially with said center point, and including an inner rim defining an opening around said center point, and an outer rim disposed at said finger distal ends so that a burner flame may be selectively directed in impingement against said ring during simmer operation, and directed radially outwardly of said ring during operation above simmer.

15. A gas range according to claim 14 wherein said gas burner is sized to operate at an input rate of about 1510 BTU/hr in said simmer operation, and said ring is joined to said fingers to thermally conduct thereto heat from said burner flame during said simmer operation and thereby reduce peak distributed heat flux at said ring.

* * * * *